US006246180B1

(12) United States Patent
Nishigaki

(10) Patent No.: US 6,246,180 B1
(45) Date of Patent: Jun. 12, 2001

(54) ORGANIC EL DISPLAY DEVICE HAVING AN IMPROVED IMAGE QUALITY

(75) Inventor: Eitaro Nishigaki, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/494,526

(22) Filed: Jan. 31, 2000

(30) Foreign Application Priority Data

Jan. 29, 1999 (JP) ..... 11-021579

(51) Int. Cl.[7] ..... G09G 3/10
(52) U.S. Cl. ..... 315/169.3; 345/55; 345/76
(58) Field of Search ..... 315/169.3, 206 R, 315/169.1, 169.2, 291, 307, 241 R; 345/55, 76, 211, 204

(56) References Cited

U.S. PATENT DOCUMENTS 4,006,383 * 2/1977 Luo et al. ..... 315/169
4,528,480 * 7/1985 Unagami et al. ..... 315/169.1
5,017,834 * 5/1991 Farnsworth ..... 315/58
5,153,483 * 10/1992 Kishino et al. ..... 315/3
5,684,365 * 11/1997 Tang et al. ..... 315/169.3
5,903,248 * 5/1999 Irwin ..... 345/90
5,952,789 * 9/1999 Stewart et al. ..... 315/169.4
6,091,203 * 7/2000 Kawashima et al. ..... 315/169.3

FOREIGN PATENT DOCUMENTS 4-247491 9/1992 (JP) .
9-305139 11/1997 (JP) .

* cited by examiner

*Primary Examiner*—Haissa Philogene
*Assistant Examiner*—Trinh Vo Dinh
(74) *Attorney, Agent, or Firm*—Foley & Lardner

(57) ABSTRACT

A drive unit for driving a corresponding one of organic EL elements of an active matrix EL display device includes a blanking switch for blanking the video signal stored in a storage capacitor in each frame period before the start of the next frame period. A drive transistor drives a corresponding EL element based on the correct current supplied for this If the video signal is a current signal, a transistor operating as a current-voltage converter is provided

7 Claims, 10 Drawing Sheets

ORGANIC EL DISPLAY DEVICE HAVING AN IMPROVED IMAGE QUALITY

BACKGROUND OF THE INVENTION (a) Field of the Invention

The present invention relates to an organic EL (electroluminescence) display device having an improved image quality and, more particularly, to a drive circuit for driving organic EL elements in an active matrix EL display device.

(b) Description of a Related Art

Flat-panel display devices now attract public attention due to their small thicknesses. Among other flat-panel display devices, an organic EL display device has an advantage of low power dissipation. In an EL display device, a plurality of EL pixels are arranged on a substrate in a matrix, each of the EL pixels having one or more of organic thin-film EL element. As a first generation of the EL display device, a simple matrix EL display device using a simple matrix driving scheme is now under development.

The simple matrix EL display device have "m" rows and "n" columns (m×n) for pixel elements, wherein each column is supplied with image data and each row is supplied with a scanning signal. An image is displayed on the screen by scanning the "m" rows periodically and sequentially with a constant cycle while supplying the "n " columns with image data.

The simple matrix EL display device has a problem in that a larger dimension of a desired screen reduces the time length used for scanning each row of the EL elements, which causes a reduction of a mean luminance on the screen or an increase of power dissipation for a higher luminance.

Thus, a next generation EL display device using an active matrix driving scheme is expected to solve the above problem.

Patent Publication JP-A-9-305 139, for example, proposes an active matrix organic EL display device such as shown in FIG. 1. The display device includes a plurality of EL pixels P11 to Pmn arranged in a m×n matrix. An analog video signal Vs is amplified in a video amplifier, corrected with respect to the characteristics thereof in a V(voltage)/I (current) correction circuit, and then supplied to each of the EL pixels P11 to Pmn. The video signal Vs is supplied to the EL pixels P11 to Pmn intermittently in a time-division system by using a scanning control circuit, which receives a synchronizing signal and controls the timing for the scanning based on the synchronizing signal.

FIG. 2 shows one of the drive units for the EL pixels shown in FIG. 1. Each pixel has an organic EL element 92 and a drive unit 91 for driving the EL element 92. The drive unit 91 includes a transfer transistor 97 controlled by a control signal Cs for receiving the video signal Vs, a storage capacitor 96 for storing the video signal in a frame period until the video signal Vs for the next frame period is supplied, and a drive transistor 95 for driving a corresponding EL element 92 with a current corresponding to the video signal Vs stored in the storage capacitor 96 in each frame period.

When the video signal Vs is to be supplied to a pixel, the transfer transistor 97 is turned on to apply the video signal Vs to a storage capacitor 96 and the gate of the drive transistor 95. The drain current of the drive transistor 95 is supplied to the organic EL element 92 as a cathode current thereof, thereby making the EL element 92 luminous during the frame period based on the drain current of the drive transistor 95.

Each organic EL element 92 in each of the pixels P11 to Pmn has a luminance based on the current supplied by the drive transistor 95, whereby the luminance of the EL element 92 is controlled at a continuous gray-scale level based on the analogue video signal Vs.

FIG. 3 shows a timing chart of the drive unit 91. When the transfer transistor 97 is ON due to an active level of the control signal Cs, the video signal Vs supplied through the signal line 98 is stored in the storage capacitor 96 for a single frame period and turns on the drive transistor 95, which supplies a drive current $I_{EL}$ to the organic EL element 92 for luminescence based on the gate voltage stored by the storage capacitor 96.

In the organic EL display device as described above, the luminescence of the organic EL element 92 during a single frame period is determined based on the video signal Vs received by the transfer transistor 97. If a dark image succeeds a bright image based on the video signal at the changeover of the frame, as shown in FIG. 3, the potential on the signal line 98 which has changed from a high voltage for a frame period to a low voltage for the next frame period is abruptly applied to the storage capacitor. At this stage, the charge stored in the storage capacitor 96 returns toward the signal line 98 through the transfer transistor 97, which received the next active level of the control signal Vs. In the changeover of the frame period, the gate voltage of the drive transistor 95 is affected by the gate voltage thereof during the precedent frame period, whereby the drive transistor 95 supplies a large current to the organic EL element 92 during the initial stage of the next frame period, thereby raising the luminance thereof above. the desired level, as shown in FIG. 3. This causes malfunction of the EL display device such as a deteriorated image or a poor contrast on the screen.

Patent Publication JP-A-4-247491 describes a drive circuit, which superimposes a blanking signal onto the scanning lines in an active matrix EL display device. In the described drive circuit, however, the blanking signal is supplied during each horizontal scanning period. Thus, this configuration does not solve the above problem caused by the function of the active matrix drive circuit in each frame period or a vertical scanning period.

SUMMARY OF THE INVENTION

In view of the above, it is an object of the present invention to provide a drive circuit for driving an organic EL element in an organic EL display device, which is capable of solving the above problem to improve an image quality on the screen.

In short, the present invention provides, in one embodiment thereof, a drive circuit for driving an organic EL element in an EL display device, wherein a blanking transistor is provided in parallel to the storage capacitor which supplies a gate voltage to a drive transistor for driving the organic EL element in each frame period. The blanking transistor receives a blanking signal for switch-on thereof, the blanking signal being made active for a specified time length just before the start of the next frame period. Thus, the storage capacitor is subjected to blanking of the precedent video signal, whereby the influence by the precedent vide signal on the organic EL element can be eliminated in the next frame period for improvement of the image quality.

The above and other objects, features and advantages of the present invention will be more apparent from the following description, referring to the accompanying drawings.

PREFERRED EMBODIMENTS OF THE INVENTION

Figure 1:
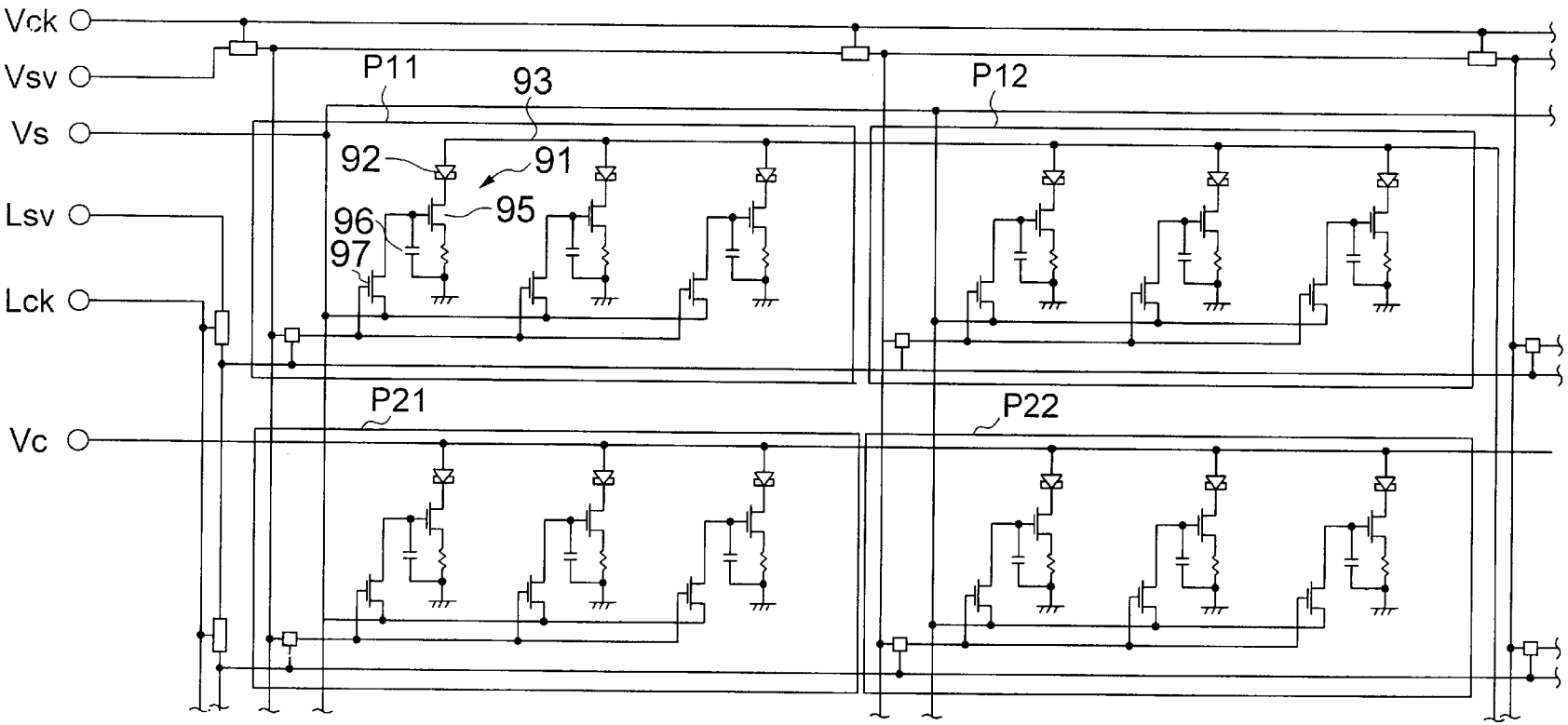
FIG. 1 PRIOR ART
FIG. 1 is a circuit diagram of a conventional active matrix organic EL display device.
Figure 2:
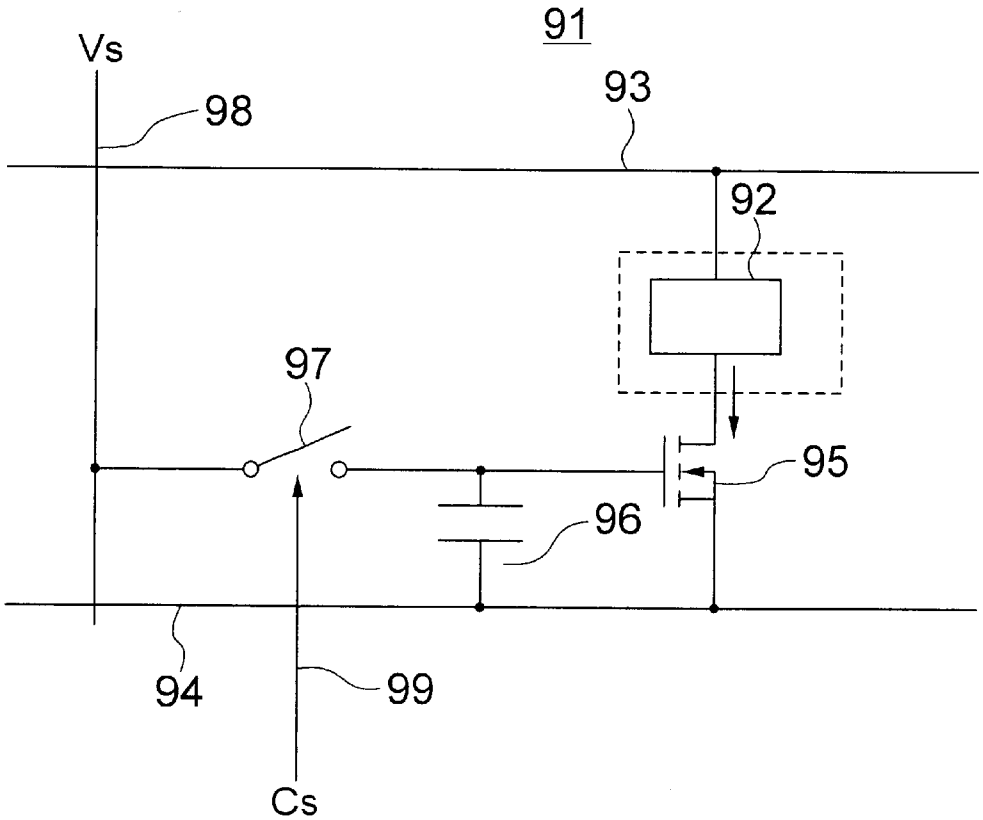
FIG. 2 PRIOR ART
FIG. 2 is a circuit diagram of one of the EL elements shown in FIG. 1.
Figure 3:
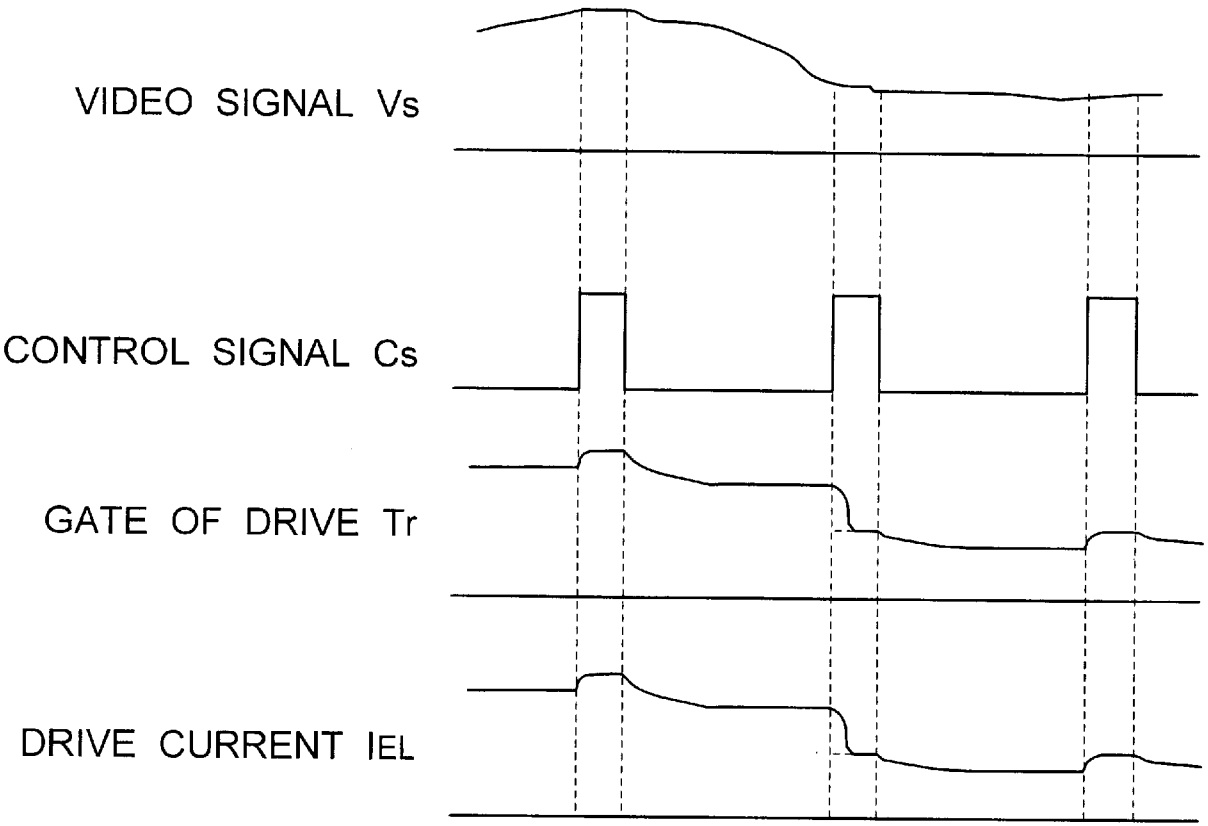
FIG. 3 PRIOR ART
FIG. 3 is a timing chart of the drive unit shown in FIG. 2.

Now the present invention is more specifically described with reference to the accompanying drawings wherein similar constituent elements may be designated by similar reference numerals.

Figure 4:
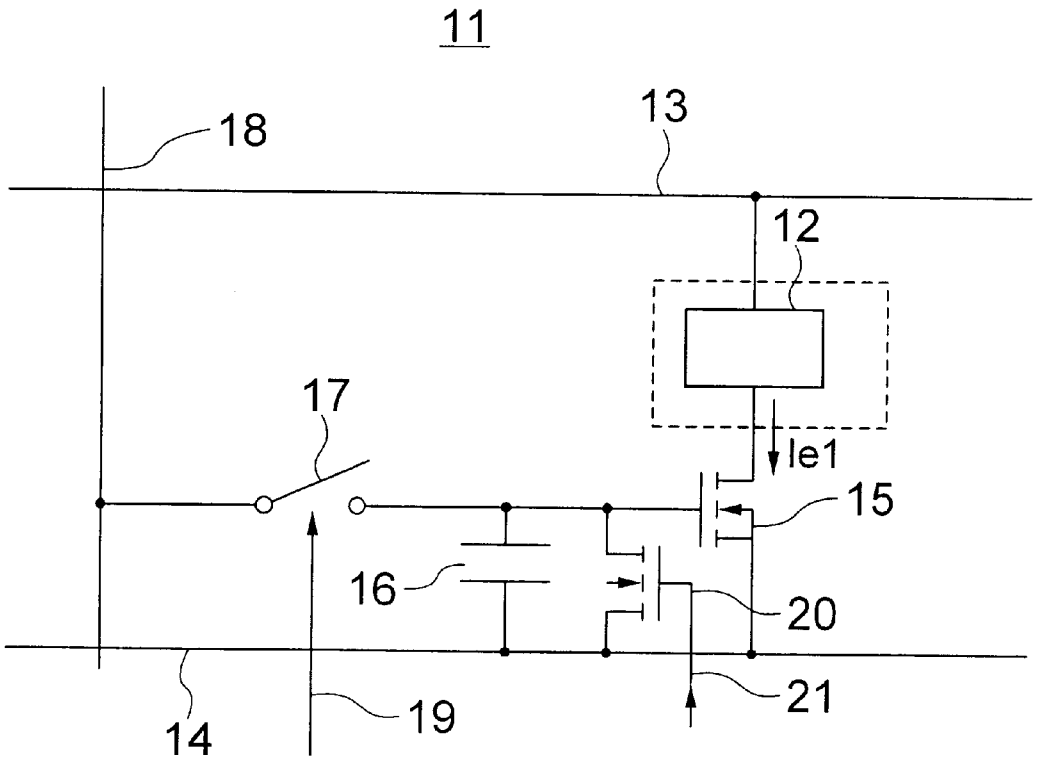
FIG. 4 is a drive unit for driving an organic EL element in an organic EL display device according to a first embodiment of the present invention.

Referring to FIG. 4, a drive unit, generally designated by reference numeral 11, is implemented as a unit element of an active matrix drive circuit for driving an EL display device according to an embodiment of the present invention. The drive unit 11 drives an organic EL element 12 disposed adjacent to the drive unit 11. The drive unit 11 includes a source line 13, a ground line 14, a drive transistor 15, a storage capacitor 16, a transfer transistor 17 shown by a symbol of switch, a signal line 18, a control signal line or scanning line 19 and a blanking transistor 20.

The organic EL element 12 and the drive transistor 15 are connected in series between the source line 13 and the ground line 14. The transfer transistor 17 has a drain connected to the signal line 18 and a source connected to the gate of the drive transistor 15. The blanking transistor 20 and the storage capacitor 16 are connected in parallel between the gate of the drive transistor 15 and the ground line 14. The transfer transistor 17 has a gate connected to the control signal line 19, and the blanking transistor 20 has a gate connected to a blanking signal line 21 which receives a blanking signal. The blanking signal is used for blanking the video signal for the frame at the end of the frame period, or before the start of the following frame period.

Figure 5:
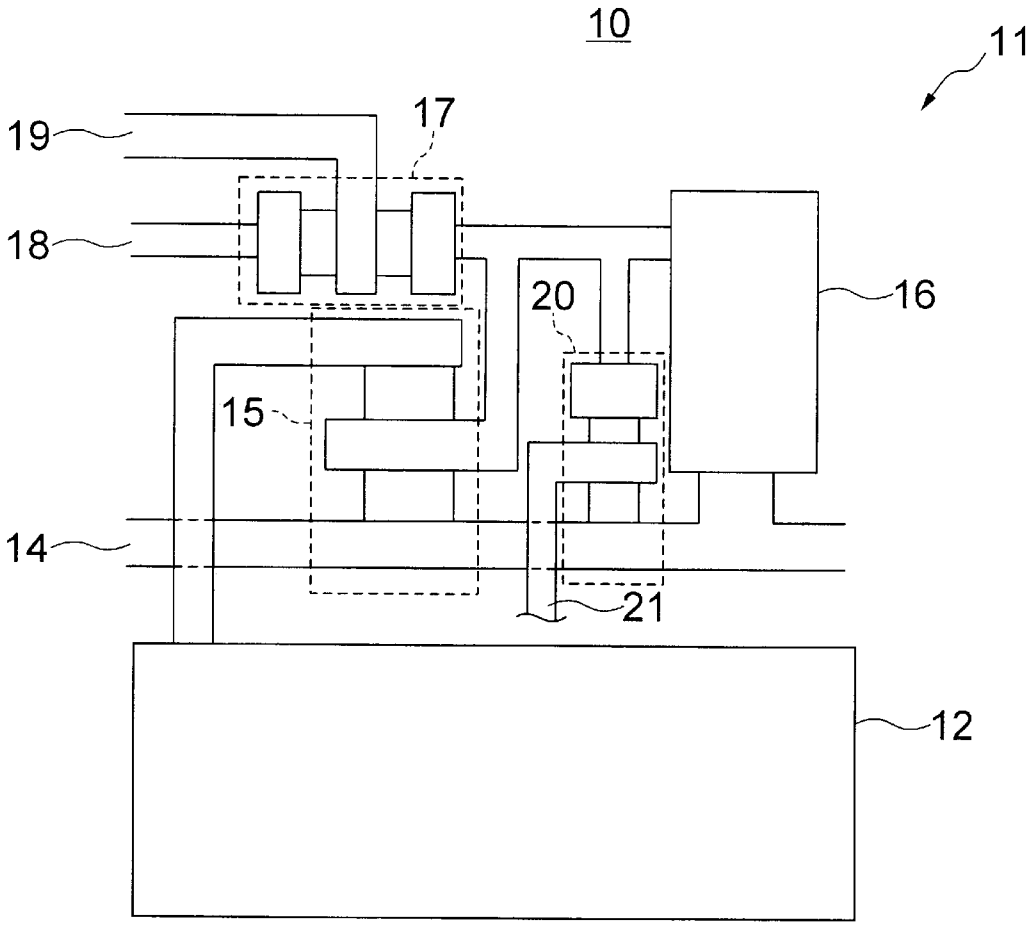
FIG. 5 is a top plan view of the layout for the drive unit of FIG. 4.

Referring to FIG. 5, the arrangement of the drive unit 11 is shown therein. The transistors 15, 17 and 20 are implemented as n-channel thin-film transistors (TFTs). The control signal line 19 is connected to the gate of the transfer transistor 17, the source-drain path of which is connected between the signal line 18 and the storage capacitor 16. The blanking signal line 21 is connected to the gate of the blanking transistor 20, the source and drain of which are connected to the ground line and the signal path between the storage capacitor 16 and the gate of the drive transistor 15, respectively. The storage capacitor 16 is connected between the ground line 14 and the gate of the drive transistor 15, the drain of which is connected to a corresponding EL element 12 disposed adjacent to the drive unit 11.

In the drive circuit shown in FIGS. 4 and 5, the organic EL element 12 is supplied with a drive current $I_{EL}$ by the drive transistor 15. The blanking transistor 20 is controlled by the blanking signal to drain the charge stored across the storage capacitor 16 to the ground line 14 for a specified time interval at the end of a frame period.

Figure 6:
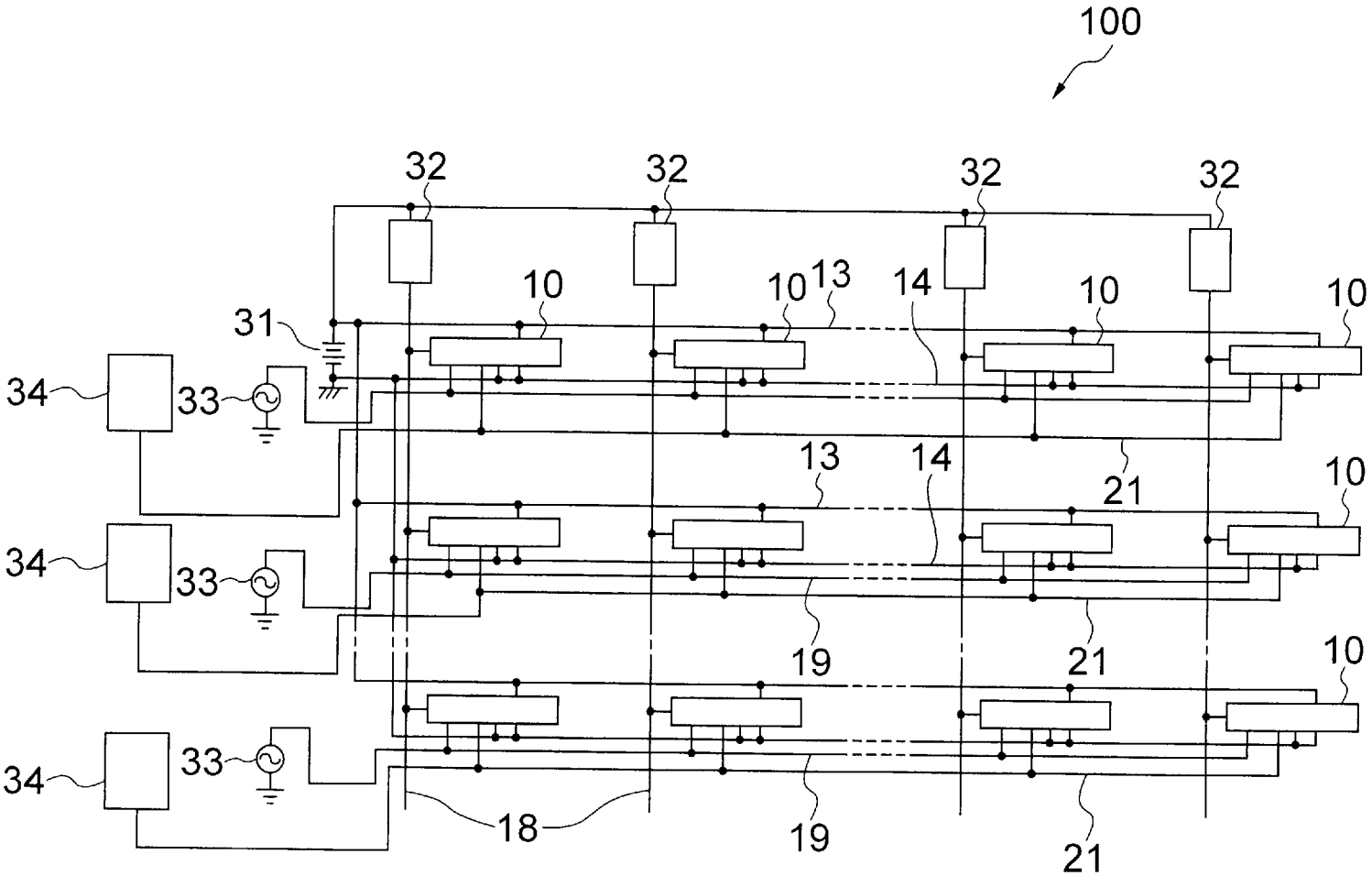
FIG. 6 is a block diagram of the organic EL display device including the drive unit of FIG. 4.

Referring to FIG. 6, an organic EL display device generally designated by numeral 100 includes a plurality of EL pixels 10 arranged in a m×n matrix ("m" rows by "n" columns) on a substrate, each of the EL pixels 10 including a drive unit 11 and an organic EL elements 12 shown in FIG. 4. Each of the "m" source lines 13 disposed for each row of the EL pixels 10 is connected in common with the other source lines 13 to a DC power source 31. Each of the "n" signal lines 18 disposed for each column of the EL pixels 10 is connected to a terminal of a corresponding one of signal drivers 32, whereas each of the "m" control signal lines (scanning lines) 19 disposed for each row of the EL pixels 10 is connected to a terminal of a corresponding one of control drivers 33. In addition, each of the blanking signal lines 21 disposed for each row of the EL pixels 10 is connected to a terminal of a corresponding one of blanking signal drivers 34. These drivers 32, 33 and 34 are controlled by an overall control circuit (not shown) for an active matrix driving scheme.

The signal drivers 32 supply video signals as either voltage signals or current signals while the control drivers 33 sequentially supply scanning signals to the respective control signal lines 19 one by one. The blanking signal drivers 34 sequentially supply the blanking signals to the blanking signal lines 21 one by one in synchrony with the clock signal which drives the control drivers 33.

Figure 7:
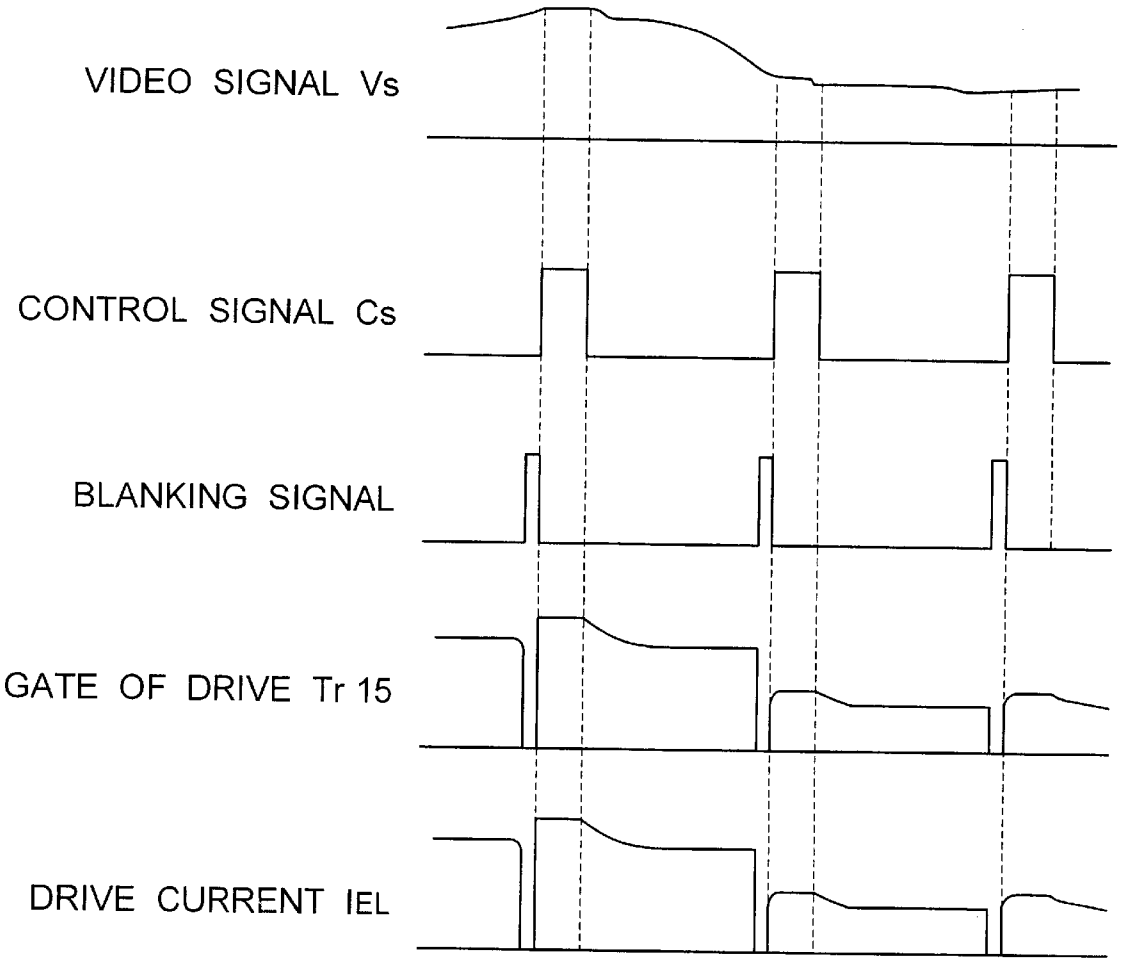
FIG. 7 is a timing chart of the drive unit of FIG. 4.

Referring to FIG. 7 in addition to FIG. 4, in operation of the EL display device, a control signal which is active during a specified interval in each frame period is supplied through the control signal line 19 to turn on the transfer transistor 17, while an analogue video signal Vs, such as shown in FIG. 7, is supplied through the signal line 18. Thus, the video signal Vs is stored in the storage capacitor 16 and supplied to the gate of the drive transistor 15. The drive transistor 15 supplies a drive current to the organic EL element based on the gate voltage of the drive transistor 15, or the video signal stored in the storage capacitor 16, in each frame period.

The drive current $I_{EL}$ for driving the EL element 12 corresponds to the gate voltage of the drive transistor 15 applied by the storage capacitor 16. The EL element 12 operates at a luminance corresponding to the drive current and continues the luminance, after the control signal is made inactive as shown in FIG. 12 to turn OFF the transfer transistor 17.

At the end of each frame period, an active level of the blanking signal is supplied to the gate of the blanking transistor 20, which turns ON to discharge the storage capacitor 16 for blanking the stored video signal. As a result, the gate voltage of the drive transistor 15 is made zero at the end of the frame period, which makes the drive current $I_{EL}$ zero.

The blanking signal is then made inactive at the start of the next frame period when the control signal is made active for the next frame period. Thus, the gate voltage of the drive transistor 15 at the start of the next frame period is determined only by the video signal at the start of the next frame, as shown in FIG. 7, whereby the drive current $I_{EL}$ for the EL element is determined only by the video signal for the next frame period. Accordingly, the luminance of the EL element 12 is determined for each frame by the video signal at the each frame.

The pulse duration and the timing of the blanking signal is determined so that the drive current dose not fluctuate at the changeover of the frame period. The blanking signal blanks the video signal for the frame period, and thus may reduce the mean luminance of the EL element in the frame. Since the organic EL element is a spontaneous luminous element, the reduction of the luminance on the screen can be compensated by raising the luminance power for the EL element at a uniform rate and thus is not serious for the function of the display unit. The organic EL display device of the present embodiment can achieve a higher contrast on the screen.

In the organic EL display unit 100 of the present embodiment, each EL pixel operates at an accurate luminance during each frame period substantially without fluctuation, whereby the image achieved on the screen is based on the accurate gray-scale level. Thus, a higher contrast can be achieved on the screen even if the video signal involves a higher-speed movement for the image or a higher-speed luminance change.

Figure 8:
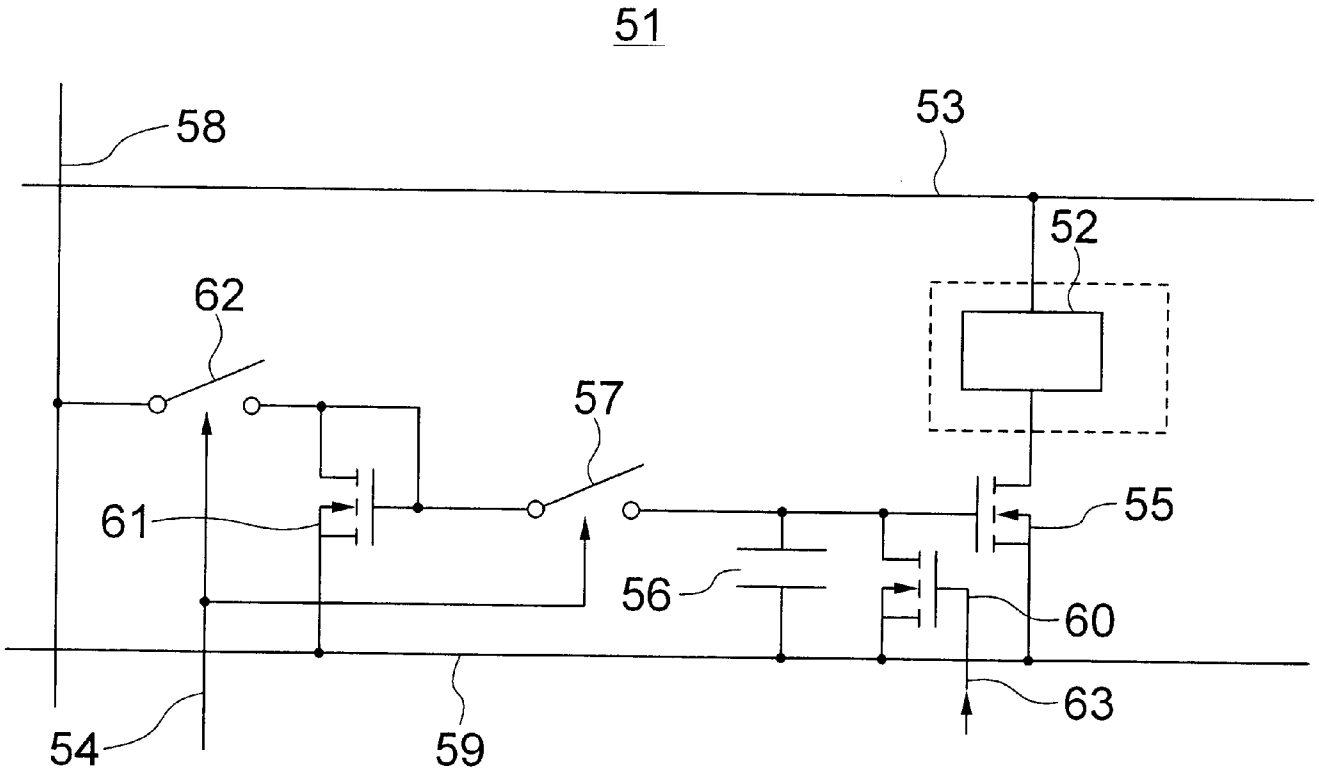
FIG. 8 is a circuit diagram of a drive unit in an organic EL display device according to a second embodiment of the present invention.

Referring to FIG. 8, a drive unit of a drive circuit according to a second embodiment of the present invention is different from the first embodiment in that the video signal is supplied as a current signal compared to the first embodiment wherein the video signal is supplied as a voltage signal. The drive transistor 55, the storage capacitor 56 and the blanking transistor 60 as well as the connection thereof are similar to those in the first embodiment.

The drive unit of the present embodiment includes a first transfer transistor 62 having a drain connected to the signal line 58 and a gate connected to the control signal line 54, a converting transistor 61 having a drain connected to the source of the first transfer transistor 62, a source connected to the ground line 59, and a gate connected to the drain thereof, a second transfer transistor 57 having a drain connected to the source of the first transfer transistor 62, a source connected to the gate of the drive transistor 55, and a gate connected to the control signal line 54.

In the above configuration, the converting transistor 61 and the drive transistor 55, when coupled together through the second transfer transistor 57, form a current mirror wherein the converting transistor 61 and the drive transistor 55 are a reference transistor and an output transistor, respectively.

Figure 9:
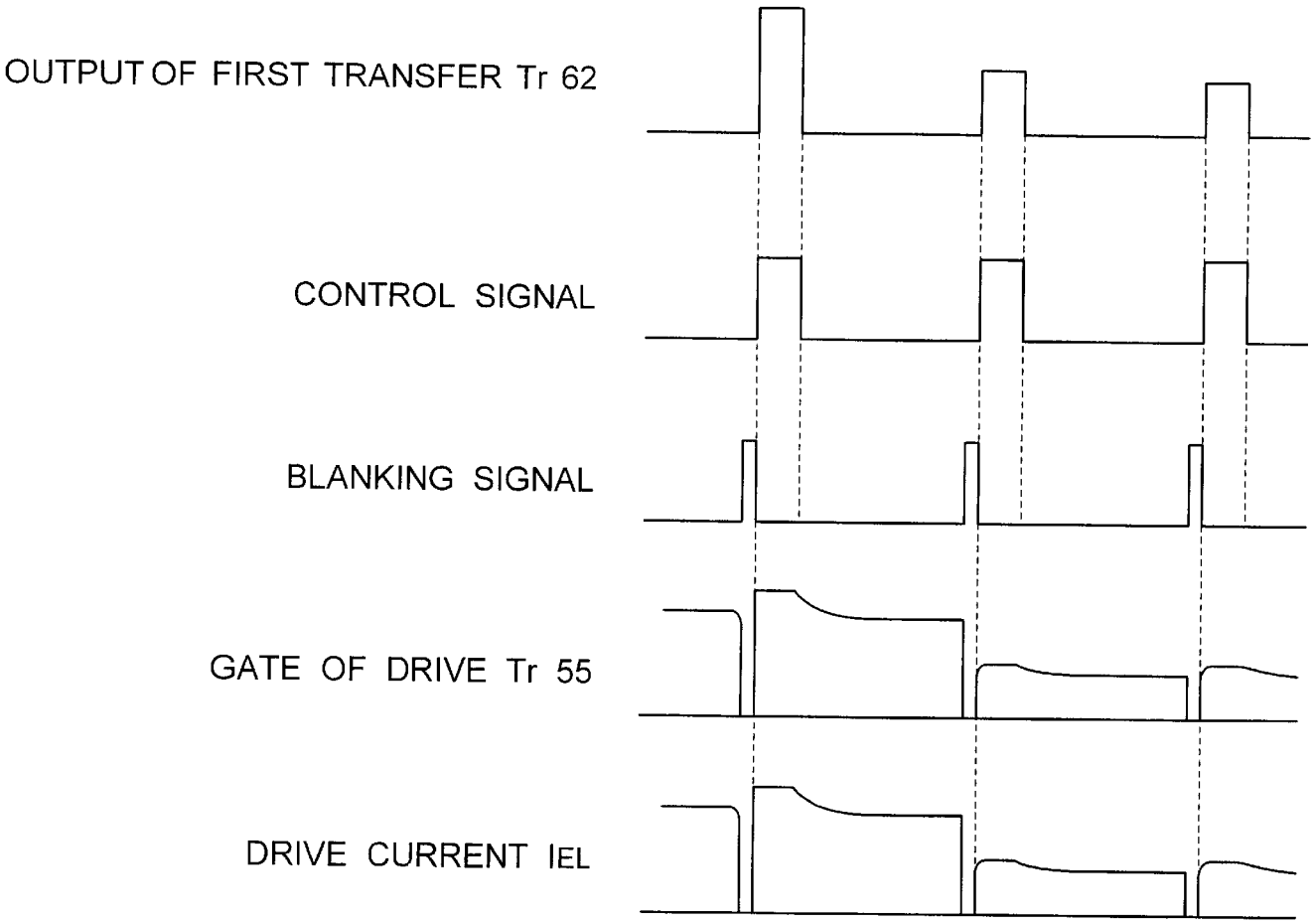
FIG. 9 is a timing chart of the drive unit of FIG. 8.

FIG. 9 shows a timing chart for the drive unit of the present embodiment. In operation, when the control signal is active in a frame period, the first transfer transistor 62 passes the current video signal, which is converted by the converting transistor 61 into a voltage video signal. The voltage video signal is then transferred through the second transfer transistor 57 to the storage capacitor 56 and the gate of the drive transistor 55, which operate in association for supplying the video signal to the EL element 52, similarly to the first embodiment.

The blanking transistor 60 is activated at the end of the frame period to blank the video signal in the frame period for preparing reception of the next video signal for the following frame period.

In the present embodiment, similarly to the first embodiment, the organic EL element operates from the start of the frame period at the luminance corresponding to the video signal supplied for the same frame due to the blanking of the precedent frame video signal. In addition, a higher contrast can be achieved on the screen even if the video signal involves therein a higher-speed movement for the image or a higher-speed luminance change.

In addition, even if the transistor characteristics of the drive transistor 55 may vary in the present embodiment due to the variations in the fabrication process, the current mirror formed by the converting transistor 61 and the drive transistor 55 allows the drive unit to operate at the accurate luminance so long as the transistor characteristics vary similarly for both the transistors 61 and 55. Thus, a higher accuracy for the luminance and a more improved image quality can be achieved in the present embodiment compared to the first embodiment.

Figure 10:
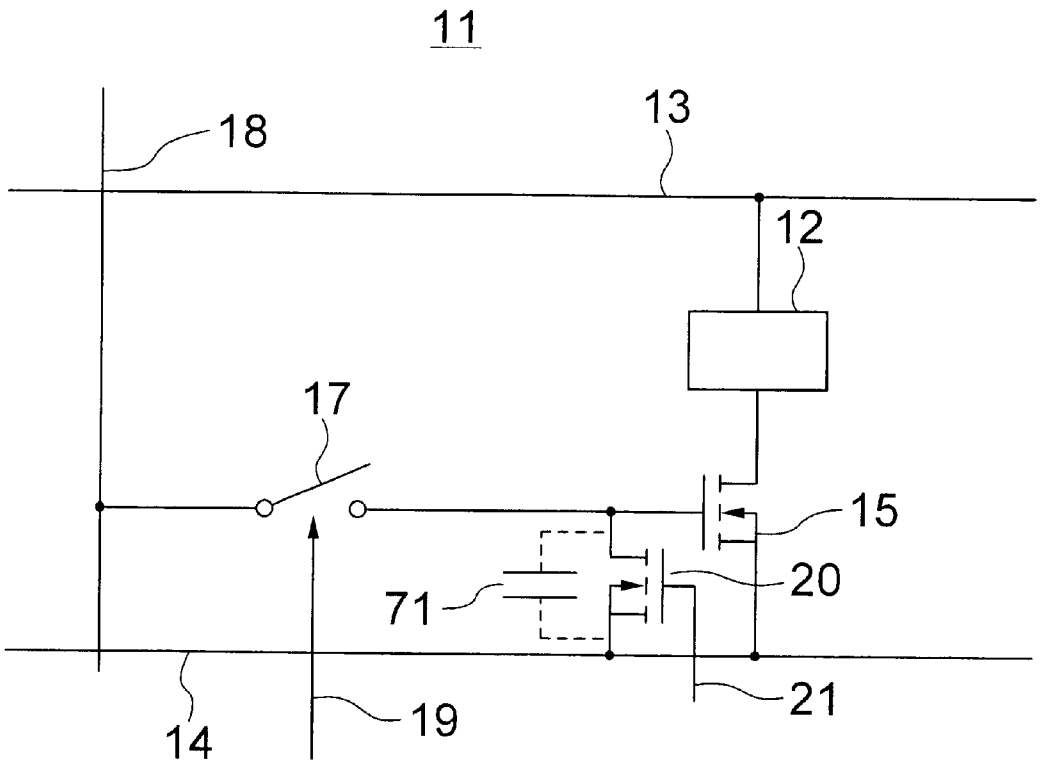
FIG. 10 is a circuit diagram of a drive unit in an organic display device according to a third embodiment of the present invention.

Referring to FIG. 10, a drive unit of a drive circuit according to a third embodiment is similar to the first embodiment except that the storage capacitor 71 in the present embodiment is implemented by a parasitic capacitance formed between the drain and the source of the blanking transistor, or between the drain and the ground. In this configuration, the occupied area for the drive unit can be reduced compared to the first embodiment, which allows a larger space for the organic EL element in each EL pixel and raise the luminescence of the each EL pixel.

The blanking transistors in the above embodiments may be disposed at any location, or may be changed from the n-channel transistor to a p-channel transistor together with corresponding modifications. The transfer transistor and the blanking transistor may be of any circuit element so long as these transistors have a switching function.

In the above embodiment, each EL pixel has a single EL element. However, the EL pixel may have a plurality of, typically three, EL elements depending on the color function of the EL display unit.

Since the above embodiments are described only for examples, the present invention is not limited to the above embodiments and various modifications or alterations can be easily made therefrom by those skilled in the art without departing from the scope of the present invention.

What is claimed is:

1. An organic EL display device comprising a plurality of EL elements arranged in a matrix, and a drive circuit including a plurality of drive units each disposed for a corresponding one of said EL elements, each of said drive units including a transfer switch, activated by a scanning signal, for transferring an analogue video signal during an active level of the scanning signal in a single frame period, a storage capacitor for storing the video signal transferred by said transfer switch, a drive transistor, controlled by the video signal stored by said storage capacitor, for supplying a current to a corresponding one of said EL elements, and a blanking switch, responsive to a blanking signal, for discharging charge stored in said storage capacitor, said blanking signal being active substantially at an end of the frame period.

2. The organic EL display device as defined in claim 1, wherein said drive unit further includes another transfer switch, activated by the scanning signal, for receiving a current signal from a signal line disposed for a column of the EL elements, and a converting transistor for converting the current signal to the video signal.

3. The organic EL display device as defined in claim 2, wherein said another transfer switch and said drive transistor form a current mirror.

4. The organic EL display device as defined in claim 1, wherein said storage capacitor is implemented by a parasitic capacitance between a drain and a source of said blanking switch.

5. The organic EL display device as defined in claim 1, wherein each of said drive transistor, said transfer switch and said blanking switch is implemented by a thin-film transistor.

6. The organic EL display device as defined in claim 1, wherein said drive circuit uses an active matrix driving technique.

7. A method for driving an organic EL display device including a plurality of EL elements arranged in a matrix, said method comprising the steps of:

consecutively transferring analogue video signals based on scanning signals in a single frame period, storing the video signal in storage capacitors and supplying currents to the EL elements based on the video signals stored in the storage capacitors in the single frame period, blanking the video signals stored in the storage capacitors at an end of the frame period for preparing transfer of the analogue video signals for a next frame period.

* * * * *